US008337742B2

(12) United States Patent
Sunthornvarabhas et al.

(10) Patent No.: US 8,337,742 B2
(45) Date of Patent: Dec. 25, 2012

(54) BUBBLE LAUNCHED ELECTROSPINNING JETS

(75) Inventors: Jakapon Sunthornvarabhas, Akron, OH (US); Darrell H. Reneker, Akron, OH (US); George G. Chase, Wadsworth, OH (US)

(73) Assignee: The University of Akron, Akron, OH (US)

( * ) Notice: Subject to any disclaimer, the term of this patent is extended or adjusted under 35 U.S.C. 154(b) by 282 days.

(21) Appl. No.: 12/679,694

(22) PCT Filed: Sep. 24, 2008

(86) PCT No.: PCT/US2008/011037

§ 371 (c)(1),
(2), (4) Date: May 24, 2010

(87) PCT Pub. No.: WO2009/042128

PCT Pub. Date: Apr. 2, 2009

(65) Prior Publication Data

US 2010/0283189 A1 Nov. 11, 2010

Related U.S. Application Data

(60) Provisional application No. 60/975,008, filed on Sep. 25, 2007.

(51) Int. Cl.
*B29C 47/08* (2006.01)

(52) U.S. Cl. ..... 264/465; 425/174; 425/174.8 E

(58) Field of Classification Search ..... 425/174, 425/174.8 E; 264/465
See application file for complete search history.

(56) References Cited

U.S. PATENT DOCUMENTS

| | | | |
|---|---|---|---|
| 2,793,396 | A | 5/1957 | Dooley |
| 4,043,331 | A | 8/1977 | Martin |
| 4,050,915 | A | 9/1977 | Brown |
| 4,878,908 | A | 11/1989 | Martin |
| 6,110,590 | A | 8/2000 | Zarkoob |
| 6,382,526 | B1 | 5/2002 | Reneker |
| 6,753,454 | B1 | 6/2004 | Smith |
| 2003/0210606 | A1 | 11/2003 | Chase |
| 2005/0073075 | A1 | 4/2005 | Chu |
| 2006/0049542 | A1 | 3/2006 | Chu |
| 2006/0234051 | A1 | 10/2006 | Zhang |
| 2007/0040305 | A1 | 2/2007 | Arrmantrout |

FOREIGN PATENT DOCUMENTS

| | | | |
|---|---|---|---|
| JP | 3918179 B | * | 5/2007 |
| JP | 3918179 B1 | * | 5/2007 |
| WO | 9803267 A1 | | 1/1998 |

OTHER PUBLICATIONS

Adrian G. Bailey, "Electrostatic Spraying of Liquids", Research Studies Press Ltd., John Wiley & Sons, 1988.

* cited by examiner

*Primary Examiner* — Joseph S. Del Sole
*Assistant Examiner* — James Sanders
(74) *Attorney, Agent, or Firm* — Renner Kenner Greive Bobak Taylor & Weber

(57) ABSTRACT

The invention relates to a novel method for electrospinning fibers wherein the fiber-spinning solution is infused with gas bubbles which travel through the electrospinning fluid, causing the bubbles to be coated with electrospinning solution. The coated bubbles, in turn, in response to an applied electrical force, generate jets of the electrospinning fluid that travel away from the bubble surface. The invention further relates to the fibers formed by this bubble-jet process and to products made therefrom.

23 Claims, 5 Drawing Sheets

BUBBLE LAUNCHED ELECTROSPINNING JETS

This application is a non-provisional patent application filing based on U.S. Provisional Application 60/975,008, from which the current application claims priority.

BACKGROUND OF THE INVENTION

The present invention is related to a process and apparatus for making fibers using electrostatic spinning from fluid polymers where bubbles are used as a source of the polymer film.

The technique of electrospinning, also known within the fiber forming industry as electrostatic spinning, of liquids and/or solutions capable of forming fibers, is well known and has been described in a number of patents as well as in the general literature.

The process of electrospinning generally involves the creation of an electrical field at the surface of a liquid. The resulting electrical forces create a jet of liquid which carries electrical charge. Thus, the liquid jets maybe attracted to other electrically charged objects at a suitable electrical potential. As the jet of liquid elongates and travels, it will harden and dry. The hardening and drying of the elongated jet of liquid may be caused by cooling of the liquid, i.e., where the liquid is normally a solid at room temperature; evaporation of a solvent, e.g., by dehydration, (physically induced hardening); or by a curing mechanism (chemically induced hardening). The produced fibers are collected on a suitably located, oppositely charged receiver and subsequently removed from it as needed, or directly applied to an oppositely charged generalized target area.

Fibers produced by this process have been used in a wide variety of applications, and are known, from U.S. Pat. Nos. 4,043,331 and 4,878,908, to be particularly useful in forming non-woven mats suitable for use in wound dressings. One of the major advantages of using electrospun fibers in wound dressings, is that very thin fibers can be produced having diameters, usually on the order of about 50 nanometers to about 25 microns, and more preferably, on the order of about 50 nanometers to about 5 microns. These fibers can be collected and formed into non-woven mats of any desired shape and thickness. It will be appreciated that, because of the very small diameter of the fibers, a mat with very small interstices and high surface area per unit mass, two characteristics that are important in determining the porosity of the mat, can be produced.

Besides providing variability as to the diameter of the fibers or the shape, thickness, or porosity of any non-woven mat produced therefrom, the ability to electrospin the fibers also allows for variability in the composition of the fibers, their density of deposition and their inherent strength. By varying the composition of the fibers being electrospun, it will be appreciated that fibers having different physical or chemical properties may be obtained. This can be accomplished either by spinning a liquid containing a plurality of components, each of which may contribute a desired characteristic to the finished product, or by simultaneously spinning, from multiple liquid sources, fibers of different compositions that are then simultaneously deposited to form a mat. The resulting mat, of course, would consist of intimately intermingled fibers of different material. A further alternative noted in the U.S. patents is to produce a mat having a plurality of layers of different fibers of different materials (or fibers of the same material but different characteristics, e.g. diameter), as by, for example, varying the type of fibers being deposited on the receiver over time. For example, wetting and non-wetting polymers each offer additional properties that may be desirable in different applications.

U.S. Pat. Nos. 4,043,331 and 4,878,908 teach that strong, non-woven mats comprising a plurality of fibers of organic, namely polymeric, material produced by electrostatically spinning the fibers from a liquid consisting of the material or precursor can be made. These fibers are collected on a suitably charged receiver and subsequently removed therefrom. The mats or linings then formed on the receiver can then be transferred and used in conjunction with other previously constructed components such as, for example, mats of woven fibers and backing layers to provide a wound dressing of desired characteristics. For instance, in producing wound dressings, additional supports or reinforcement such as mats or linings of woven fibers, or backing layers are required in order to adhere the wound dressing to the skin and to provide other desirable properties to the wound dressing. As an example, a mat or lining of woven fibers may contain materials having antiseptic or wound-healing properties. Surface treatments of the already formed non-woven mats may also provide added benefits in the production of such wound dressings.

It has also been described in PCT Application No. WO 98/03267 to electrostatically spin a wound dressing in place over a wound. In such a use, the body itself is grounded and acts as a collector of the electrospun fibers. This method of synthesizing a wound dressing allows for solution of some of the problems associated with bandage and gauze storage and preparation. It is well known for example, that gauze and bandages must be stored and maintained in a sterile environment in order to offer the greatest protection in healing wounds. If the gauze or bandages are not sterile, these products offer little help in protecting the wound. Electrospinning a wound dressing in place, over a wound, from a sterile liquid, eliminates these problems.

As mentioned above, electrospinning involves the creation of a jet of fluid in an electrical field. The jet of fluid elongates and hardens or dries as it travels toward its target. The resulting fibers are deposited in a random and diffuse manner. This results in material being deposited outside the target area, causing waste. The general electric field on which formation of fibers depends, may also preclude deposition of fibers in the deepest part of a laceration or other deep wound, because fibers will be attracted to and deposit themselves on the portion of the wound closest to the electrospinning apparatus. The rate of hardening or drying is also dependent on factors such as the path length of the jet of fluid. This, in turn, influences the physical characteristics of the non-woven article.

BRIEF DESCRIPTION OF THE DRAWINGS

The attached Figures are provided to assist one skilled in the art in better understanding various embodiments of the invention. They are intended to be merely representative, however, and in no way limit the invention to only those embodiments shown. Like numbers are used throughout the following description and in the various Figures/embodiments shown to identify the same features.

DETAILED DESCRIPTION OF THE INVENTION

Figure 1:
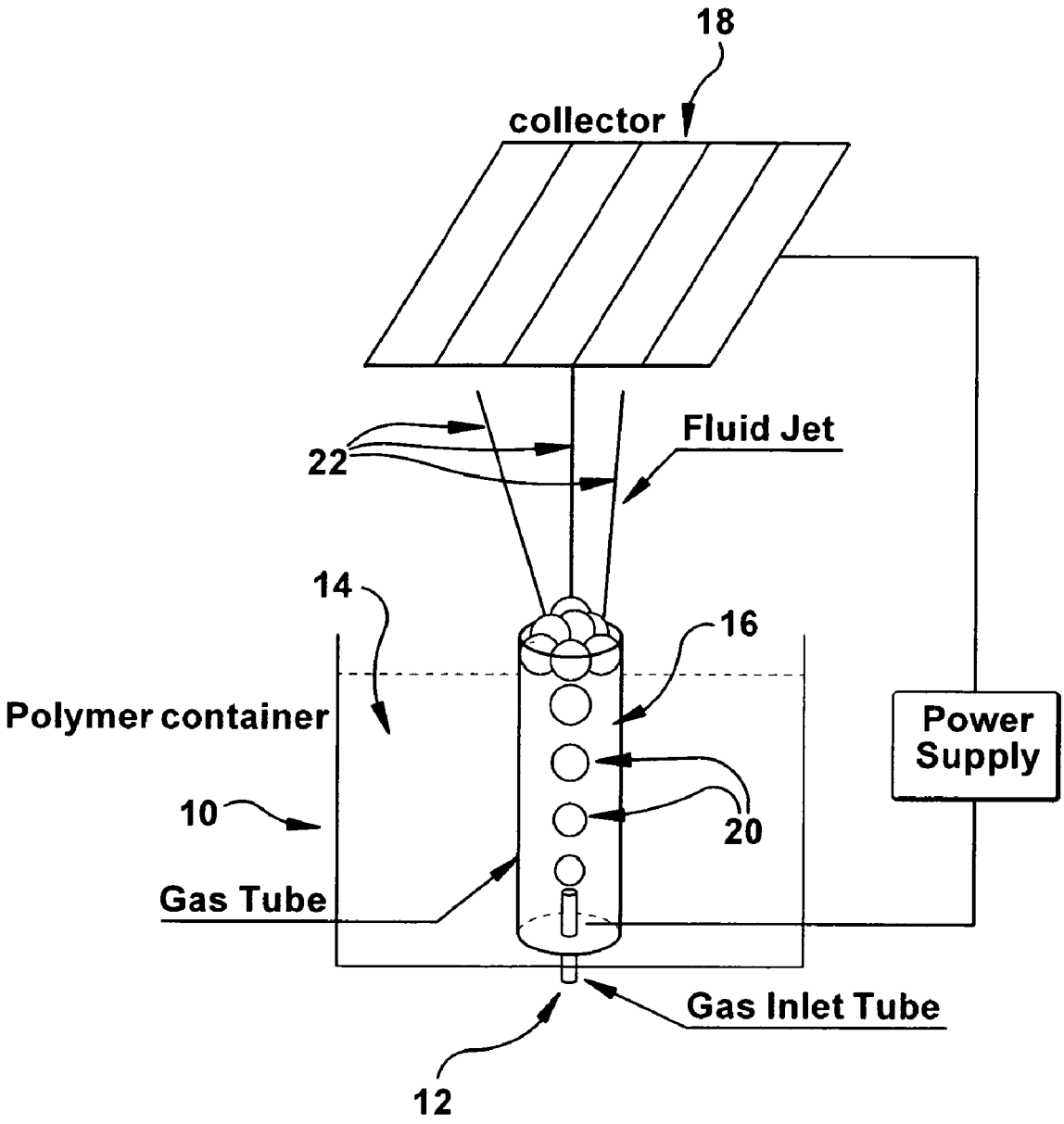
FIG. 1 provides a diagram of a single gas tube apparatus according to the invention.

The present invention relates to a novel method for electrospinning fibers wherein the fiber-spinning solution is infused with gas bubbles which travel through the electrospinning fluid, causing the bubbles to be coated with electrospinning solution. The coated bubbles, in turn, in response to an applied electrical force generate jets of the electrospinning fluid that travel away from the bubble surface. The invention further relates to the fibers formed by this bubble-jet process and to products made therefrom.

As used herein, the term "spinning fluid" means any composition from which a fiber jet may be created or spun. Such fluids include any fluid that is capable of supporting the generation of a jet of fluid in response to an applied electric field. One example of such a fluid is a polymeric composition, though many others options exist. Further, the spinning fluid may include particulate matter entrained or suspended therein. For example, the fluid may include any particulate material that it is desirable to include in the end product. Such particles may include superabsorbent particles, chemical reagents, catalysts, biological molecules, organelles, cells, and many other types of particulate matter. The composition of the fluid itself or that particulate matter that may be included is not a limiting factor of this invention.

Further, the invention provides an apparatus to generate and collect fibers by known electrospinning techniques. As such, the physical and performance parameters of the actually spinning process, i.e., applied voltage, collector positioning and distance, and other operating conditions are not in and of themselves limiting factors of this invention, unless otherwise stated and/or shown herein.

In one embodiment, the present invention relates to a method and apparatus for creating fibers from a spinnable fluid using bubbles as a platform for launching the fluid jets which eventually become the fibers. Therefore, there is provided a source of spinning fluid infused with one or more gas bubbles, and a mechanism for applying an electric force to a bubble causing a jet to emerge from the bubble surface. The use of bubbles as a platform for generating fibers from suitable spinning solutions or fluids provides an important advance in fiber spinning technology. The bubble provides a means of concentrating electrons at the fluid surface in a manner that promotes the formation of a field gradient strong enough to overcome the surface tension forces of the fluid, resulting in the launching of a jet of fluid. The shape of the bubbles naturally enhances the concentration of the electrons at the apex of the bubble, which is not possible on a flat surface, making launching of a jet of fluid from the bubble apex easier and more controllable. The jets of fluid initially follow the local electric field at the surface of the bubble, and then curve as they experience the electrical attraction from a suitable collector. Each bubble has the potential to create or generate multiple jets, either simultaneously or in succession, or both, with each jet becoming a fiber. Given the foregoing, the process provides a renewable means of generating fibers. This invention uses bubbles with diameter ranging from 1 mm to 20 mm.

The bubbles are created by the introduction of gas to the fluid. In that instance where more than one gas inlet is provided, each inlet may introduce the same or different gases to the spinning fluid. The gas can be any substance that will create a bubble at ambient conditions, i.e., temperature, pressure, etc., that surround the electrospinning apparatus. For example, the gas may be air, nitrogen, carbon dioxide, or any inert gas that is convenient to the process and does not react with the spinning fluid. If the gas is very soluble in the spinning fluid, i.e., having a solubility such as that of carbon dioxide in water, the bubbles may be created merely by evaporation of the gas from the liquid. Foaming agents that release gas as the jet is elongated may create "chains of bubbles" in the resulting fibers. Alternatively, or in addition, nanofibers having varying configurations may be made to include bubbles on the interior thereof depending on the geometric arrangement.

In another embodiment, there is provided a self-starting fluid jet launcher. The terms "self-starting" and "renewable" are used herein to indicate that even if the jet stops momentarily, it will restart. More specifically, available fluid that forms the bubble is, as it reaches the surface, drawn off as a jet. As the fluid is drawn into the jet, the bubble eventually collapses and the fluid source is lost. However, the process is repeated as subsequent bubbles reach the fluid surface and undergo the same jet formation process.

In more conventional jet forming methods and processes, the jet may be generated from the tip of an orifice. In the current design, however, the jet is generated from a bubble traveling freely through the spinning fluid. Once the jet is formed and launched from the bubble surface, solvent evaporation causes the outer surface of the jet to become more concentrated, forming a type of skin on the jet surface, and resulting in a jet that exhibits enhances mechanical strength. To some degree, the core of the jet, or the fluid more near the core of the jet, may retain its fluid characteristics. As the skin forms, the solvent in the fluid that is in the center to the jet will have to diffuse through the skin in order to evaporate. Thus, the center of a jet may remain liquid.

Now, the invention will be described with reference to the Figures, though any Figure is merely exemplary and provided to aid the reader in understanding the invention. Numeric references may be carried throughout the description of the Figures or may be changed to more clearly identify features thereof.

In one embodiment, a gas tube or column is provided for use in the process according to the invention. As shown in FIG. 1, the invention provides an apparatus including a gas inlet 12 opening into the bottom of a reservoir 10 containing a fiber spinning solution or fluid 14. Positioned within the reservoir 10 is a gas tube 16, the distal ends of which are open to allow fluid or gas to traverse through the internal cavity of the gas tube. As gas from an external source (not shown) enters the reservoir 10 and rises through the spinning fluid 14 in the gas tube 16, bubbles 20 are created. The bubbles rise to the surface of the fluid through the gas tube and form a group of bubbles at or near the surface of the fluid. By controlling the rate of gas flow, the rate of bubble generation, diameter of gas inlet tube 12, properties of a fiber spinning solution or fluid 14, the size of the bubbles and the rate at which the bubbles rise to the surface can be controlled. Rising bubbles will congregate or pile up at the fluid surface as the gas flow continues. As such, and because jets will only be formed as the bubble reaches the surface, the rate of fiber generation is also controlled. Positioned at that upper end or the portion of the gas tube toward which the bubbles travel is collector 18. An electrical power source runs between collector 18 and the spinning fluid 14 creating a voltage between the spinning fluid and the collector, which eventually builds to the point where the electrical force overcomes the surface tension of the bubble, forcing one or more jets 22 of fluid to emerge from the bubble surface. The emerging jets approach the charged collector 18, and undergo drying in the process of traveling toward the collector, as described above. As a jet dries, it forms a fiber, which is then deposited on the collector surface. It is to be understood that any suitable collector may be used.

Figure 2:
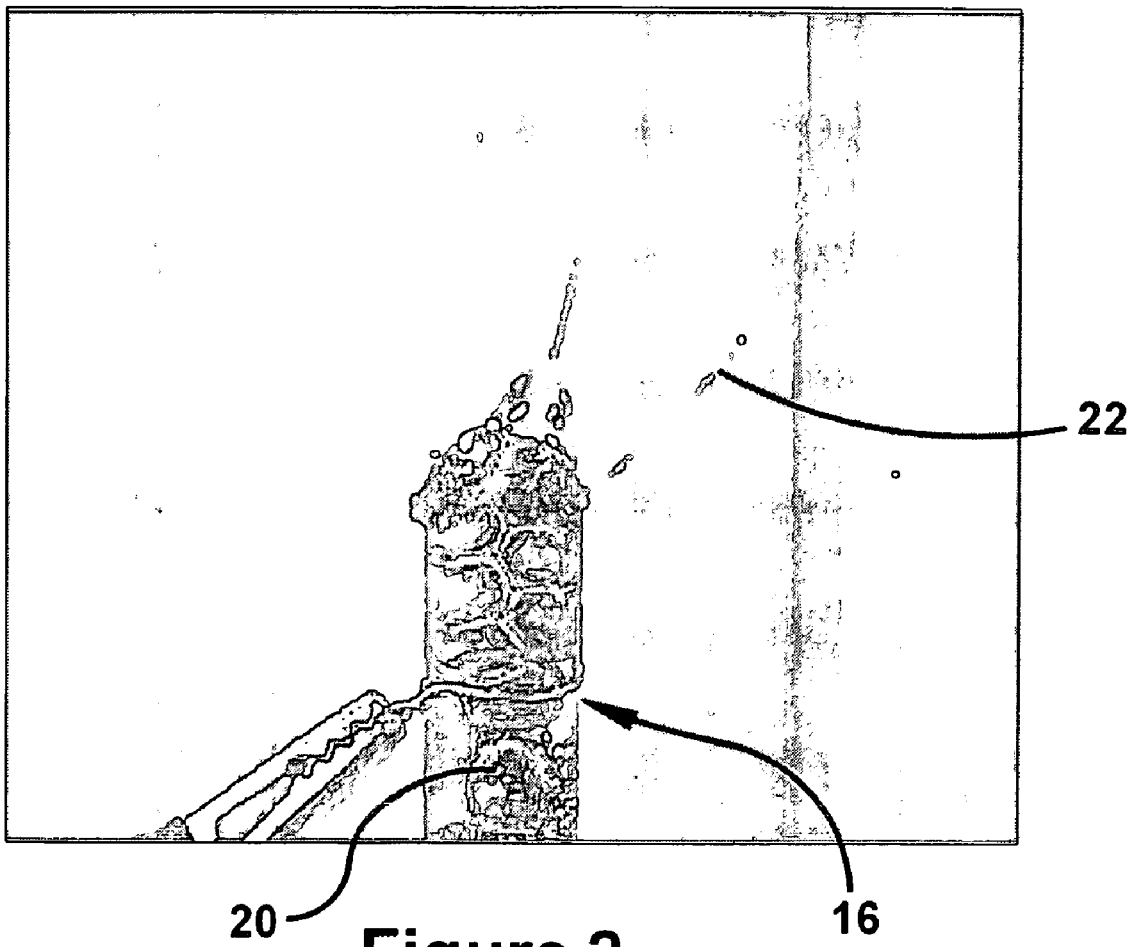
FIG. 2 provides a photograph of an actual single gas tube apparatus according to the invention.

FIG. 2 provides a photograph, magnified at about 5 times magnification, of an actual gas tube apparatus according to the invention and in keeping with one embodiment thereof. In this photographic representation, gas tube 16, having a diameter of 10 mm, is clearly visible, and has bubbles 20 collecting near the upper end of the gas tube. In addition, two jets 22 are visible as they project toward a collector, not shown.

A bubble may or may not break immediately. Bubble collapse, or break, occurs after the fluid in the bubble wall launches from the surface as a jet thereof is generated in response to an applied electric field. During this process, the bubble wall weakens until the force holding the bubble together is no longer strong enough to counter gravity or other external forces, and the bubble collapses. At this point, the jet being supported by a given bubble disappears, but the jet thus far created has undergone solvent evaporation and hardening to leave behind a collectable fiber. It has been observed that at the point of breaking multiple jets may be launched from a single bubble, though they are not likely to be sustained. As one bubble collapses, another rises to the surface, experiencing a higher electric field as it rises, and the process of launching a jet is repeated, hence the term "renewable" jet forming process. The rate of fiber formation is therefore, in one respect, limited by the rate at which new bubbles arrive at the fluid surface. Conversely, if the rate at which bubbles undergo collapse is slower than the rate of the arrival of bubbles at the fluid surface, an almost continuous process of fiber production may occur.

Figure 3:
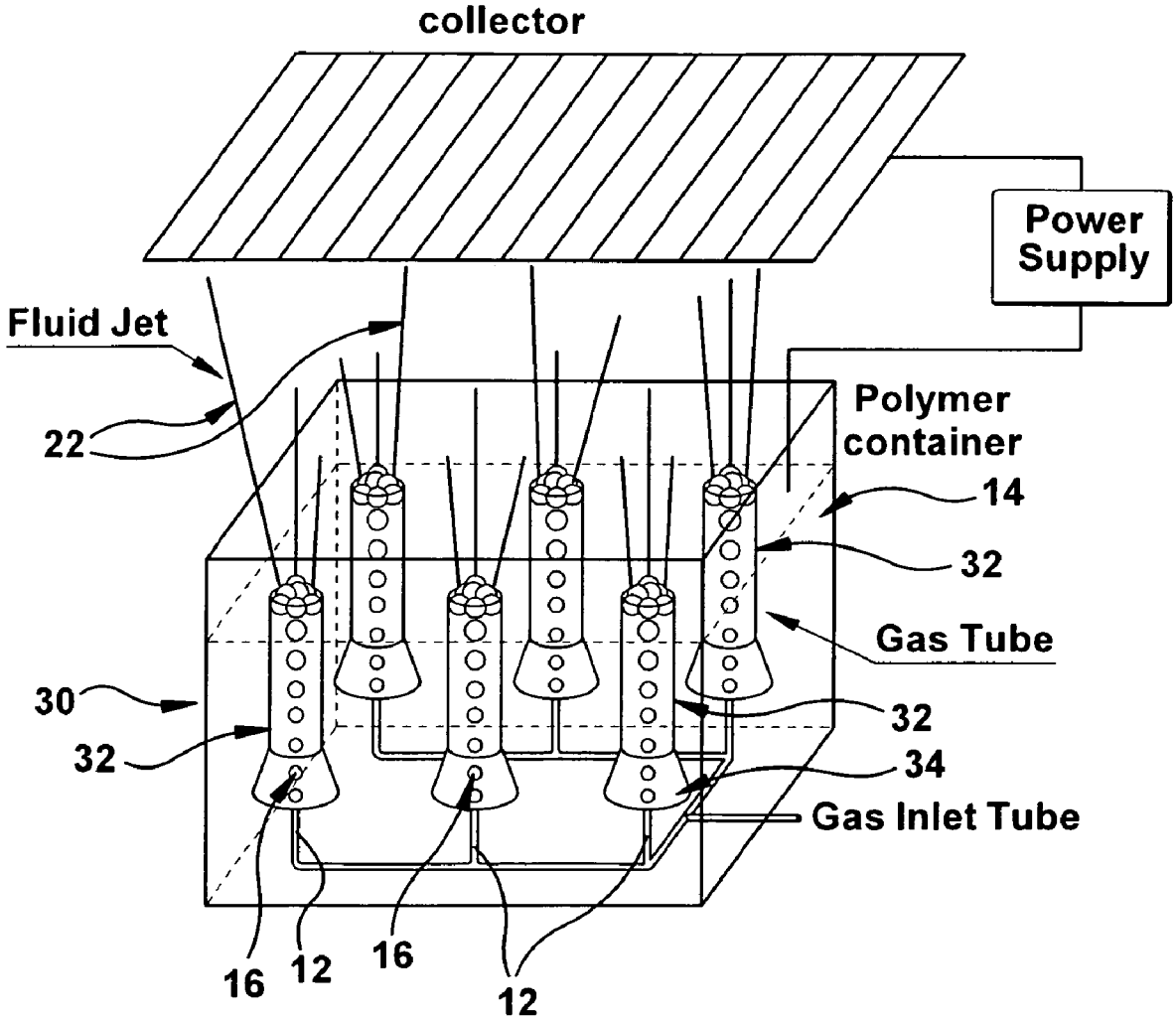
FIG. 3 provides a diagram of a multiple gas tube apparatus according to the invention.

In another embodiment of the invention, as seen in FIG. 3, multiple gas inlets 12 can be positioned to emit gas into reservoir 30, creating multiple bubbles simultaneously. In this embodiment, reservoir 30 houses multiple gas tubes 32, which function in keeping with gas tube 16 of FIG. 1. The gas tubes 32 are positioned to control the path of bubbles 16 created as gas from gas inlets 12 rises through the spinning fluid 14. As the bubbles reach the surface, jets 22 are generated in keeping with the process set forth above. As such, in this embodiment the bubbles in reservoir 30 produce multiple jets 22 which may be collected. Using this embodiment, the jets 22, generated from multiple gas tubes having multiple bubble sources, may create a non-woven sheet of fiber at a relatively high rate.

In yet another embodiment, the apparatus of FIG. 3 includes flared openings, 34, having a diameter at the lower edge thereof nearest the gas inlet 12 in excess of the diameter of the main body of the gas tube. Flared opening 34 is optimally placed in proximity to but spaced apart from a gas inlet 12 such that bubble from inlet 12 is captured by and rises through flared opening 34 and into the main body of gas tube 30. These flared openings 34, which in the embodiment shown have a conical shape but which may be of any shape convenient to the capture and directing of gas bubbles, aid in the collection of bubbles that do not rise directly upward to the polymer surface.

Figure 4:
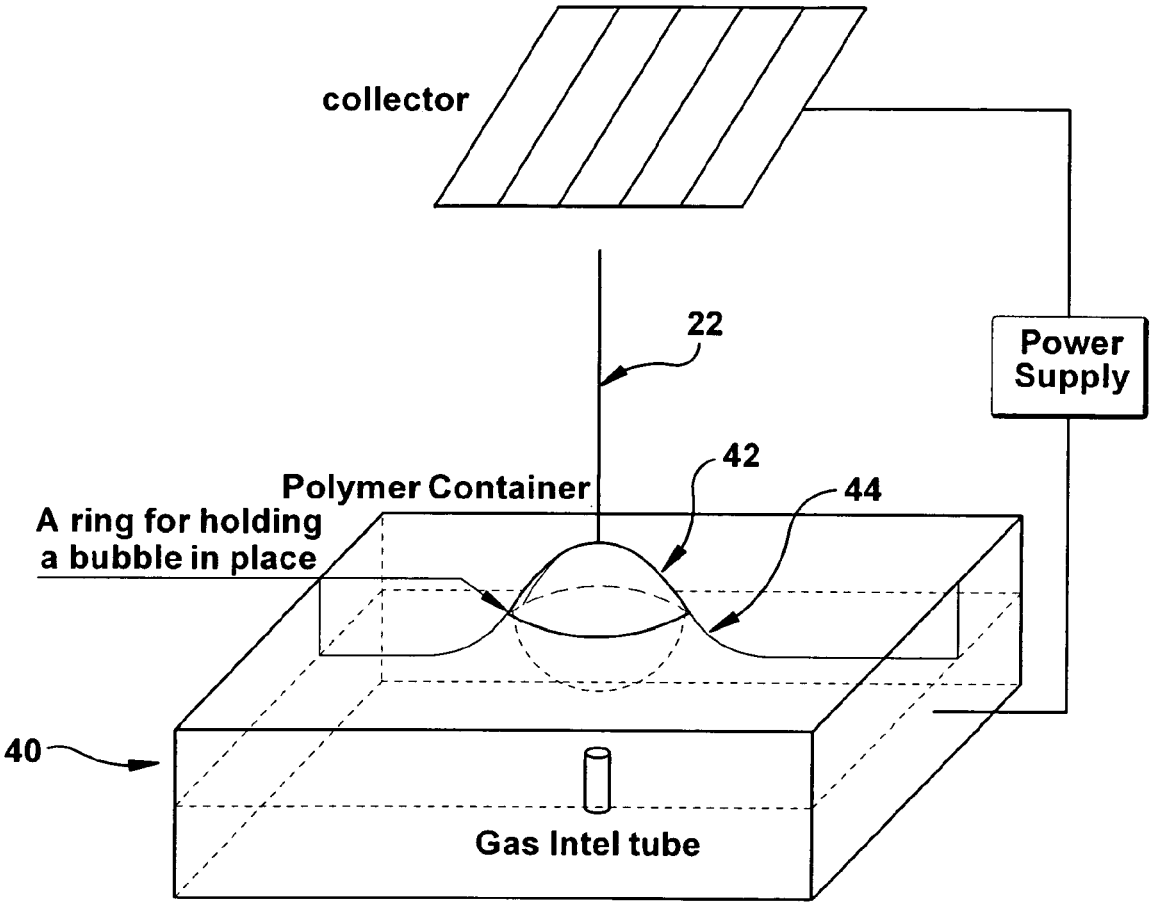
FIG. 4 provides a diagram of a single bubble jet apparatus according to the invention.

In yet another embodiment, and in keeping with FIG. 4, reservoir 40 encourages the creation of a single bubble 42 which rises to the surface to generate jet 22. As bubble 42 rises to the fluid surface it floats there supporting a single jet 20 for an extended period of time. By controlling such parameters as the rate of solvent evaporation and the rate of gas flow, the physical size and parameters of the fiber may be controlled. In certain embodiments, using the apparatus of FIG. 4, a ring 44 or other means may be used to keep the bubble stationary, which may be desirable to maintain uninterrupted jet formation. In some instances, it may be desirable to move the bubble, as by use of a gas stream or other mechanical means, in order to direct the fiber collection in a desired pattern or manner. Additionally, the generation of fibers may be controlled by controlling the size of the bubble, i.e., a smaller bubble may launch a jet sooner than a larger bubble having greater surface area to be acted upon by the electrical forces. As is seen, many factors in the process can be manipulated to achieve differing results in fiber formation and characteristics.

Figure 5:
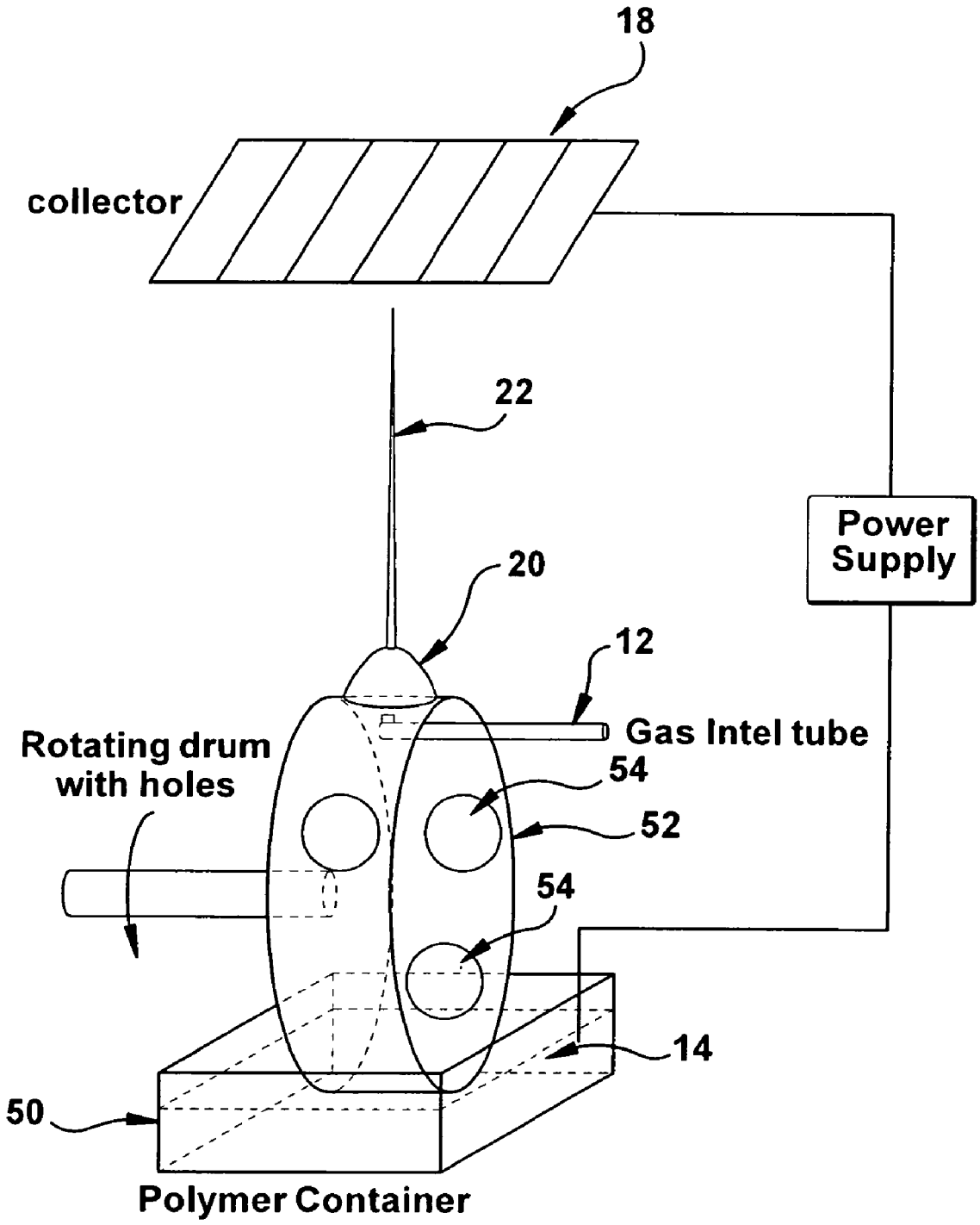
FIG. 5 provides a diagram of a rotating drum bubble jet apparatus according to the invention.

In still another embodiment, FIG. 5 illustrates an apparatus 50 including a drum 52 having one or more holes 54 or apertures through the thickness thereof. Drum 52 is placed in contact with the surface of the fluid 14, such that a film of fluid 14 is collected on the drum, including over holes 54, as it passes through the fluid. Drum 52 is rotated by a motor or other source of power. The depth at which the drum passes through the fluid is not critical. Gas inlet 12 is positioned with respect to the drum such that as gas is expelled from the inlet it contacts the interior surface of drum 52. As any one of the holes 54 rotates past gas inlet 12, the gas contacts the fluid film covering the hole 54, creating an inflated a dome-shaped bubble 20. In keeping with the preceding embodiments, as the electric field increases to a point where it overcomes the surface tension of the fluid film on drum 52, the excess force causes a jet 22 to emerge from dome-shaped bubble 20, which then dries and can be collected in any suitable manner on collector 18.

The invention has been described with reference to various embodiments, however, those embodiments are not in any way limiting of the scope of the invention, but are merely exemplary thereof. The invention is to be understood to include the full breadth and scope of all claims appended hereto.

What is claimed is:

1. An apparatus for electrospinning fibers comprising: a reservoir containing a spinning fluid; a gas tube having openings at the distal ends thereof and positioned in the interior of the reservoir such that the fluid in the reservoir fills the gas tube; a gas inlet in fluid communication with the reservoir and positioned to release gas into the fluid to create one or more bubbles therein; and a collector in electrical communication with the fluid, positioned to attract and receive jets generated from the surface of the one or more bubbles in the fluid as they rise to the fluid surface.

2. The apparatus of claim 1 wherein the fluid is a polymeric composition.

3. The apparatus of claim 1 wherein the fluid includes particles.

4. The apparatus of claim 1 wherein the gas tube has a geometry selected from cylindrical, square, triangular, and polygonal.

5. The apparatus of claim 1 wherein the gas inlet is connected to a source of gas external to the reservoir, the gas being selected from air, nitrogen, carbon dioxide, or an inert gas that is non-reactive with the spinning fluid.

6. The apparatus of claim 1 wherein the reservoir houses multiple gas tubes.

7. The apparatus of claim 1 wherein the apparatus includes multiple gas inlets.

8. The apparatus of claim 7 wherein each of the gas inlets is connected to the same or a different source of gas, and wherein each source of gas comprises the same gas or different gases.

9. The apparatus of claim 1 wherein the gas tube includes a flared opening at the end thereof proximate the gas inlet.

10. The apparatus of claim 1 wherein the apparatus further includes a structure to retain a bubble produced by gas entering the apparatus in one position on the surface of the fluid.

11. The apparatus of claim 1 further including a drum having apertures therein in contact with the surface of the fluid in the reservoir and capable of rotating through the fluid to collect fluid on the surface of the drum.

12. The apparatus of claim 11 wherein the gas inlet is positioned to emit gas through the apertures as the drum rotates past the inlet, creating a bubble of gas at the position of the aperture.

13. A renewable fiber electrospinning process comprising: providing a reservoir containing a spinning fluid; providing at least one gas inlet to allow gas from a source external to the reservoir to enter the reservoir creating at least one bubble in the fluid; providing at least one gas tube positioned in the interior of the reservoir to direct the path through which the at least one bubble rises toward the upper surface of the fluid in the reservoir; providing an electrical field and allowing the electrical field to build until it overcomes the surface tension on the at least one bubble causing at least one jet of fluid to be launched from the surface of at least one bubble; and collecting at least one launched jet, on a collector which attracts the jet, in the form of at least one fiber.

14. The process of claim 13 wherein multiple bubbles in multiple gas tubes launch jets simultaneously.

15. The process of claim 13 wherein one gas tube contains multiple bubbles, each of which sequentially launches a jet for continuing collection on the collector.

16. The process of claim 13 wherein the flow rate of the gas is controlled to control the rate of jet formation.

17. The process of claim 13 wherein the environmental parameters surrounding the reservoir are controlled to control the fiber characteristics.

18. The process of claim 13 wherein the spinning fluid includes particles to be included in the resulting fibers.

19. The process of claim 13 wherein the fibers form a mat.

20. A method for electrospinning fibers comprising infusing a fiber spinning fluid with gas creating at least one bubble, providing at least one gas tube positioned in the interior of the reservoir to direct the path through which the at least one bubble rises toward the upper surface of the fluid in the reservoir, such that as the gas bubble travels through the fiber spinning fluid the bubble is coated with the fiber spinning fluid and, in response to an applied electrical force, generates jets of the fiber spinning fluid that are collected as fibers.

21. The method of claim 20 wherein the fiber is a nanofiber.

22. The method of claim 20 wherein the fiber spinning fluid is a polymer solution.

23. The method of claim 22 wherein the fiber spinning solution further includes a particulate component that becomes part of the fiber.

* * * * *